US009533489B2

(12) United States Patent
Andersen

(10) Patent No.: US 9,533,489 B2
(45) Date of Patent: Jan. 3, 2017

(54) APPARATUS FOR REGISTER CONTROL AND A METHOD FOR REGULATING SUCH APPARATUS

(71) Applicant: Tresu A/S, Bjert (DK)

(72) Inventor: Claus Hjulmann Andersen, Fredericia (DK)

(73) Assignee: Tresu A/S, Bjert (DK)

( * ) Notice: Subject to any disclaimer, the term of this patent is extended or adjusted under 35 U.S.C. 154(b) by 0 days.

(21) Appl. No.: 15/023,497

(22) PCT Filed: Sep. 22, 2014

(86) PCT No.: PCT/DK2014/050299
§ 371 (c)(1),
(2) Date: Mar. 21, 2016

(87) PCT Pub. No.: WO2015/039671
PCT Pub. Date: Mar. 26, 2015

(65) Prior Publication Data

US 2016/0229175 A1 Aug. 11, 2016

(30) Foreign Application Priority Data

Sep. 23, 2013 (DK) ..... 2013 70531

(51) Int. Cl.
*B41F 21/00* (2006.01)
*B65H 7/08* (2006.01)
(Continued)

(52) U.S. Cl.
CPC ..... *B41F 21/00* (2013.01); *B65H 7/08* (2013.01); *B65H 9/06* (2013.01); *B65H 9/101* (2013.01); *B65H 11/005* (2013.01); *B65H 29/125* (2013.01); *B65H 29/68* (2013.01); *B65H 43/04* (2013.01); *B65H 2511/20* (2013.01);
(Continued)

(58) Field of Classification Search
USPC ..... 101/242
See application file for complete search history.

(56) References Cited

U.S. PATENT DOCUMENTS 3,663,011 A 5/1972 Mowry et al.
4,227,685 A 10/1980 Fischer
(Continued)

FOREIGN PATENT DOCUMENTS

CA 2 158 388 A1 4/1996
DE 10 2009 025 588 A1 1/2010
(Continued)

*Primary Examiner* — Joshua D Zimmerman
(74) *Attorney, Agent, or Firm* — David S. Safran

(57) ABSTRACT

An apparatus for conveying a sheet-formed item from a digital printing unit, the apparatus including an inlet side and an outlet side, and including a set of conveying devices for moving items in a conveying direction and a method for regulating such an apparatus. The apparatus includes a device for aligning an article from one position to another position in relation to one or more reference points, and a device for fixing an item at a given position in relation to a stop. The method includes the steps: detecting an item; receiving and conveying the item; regulating a possible skew position of the item as the item is moved against a stop on the conveying device, where the item is acted on by one speed of the conveyor belt and moved into abutment on the conveying means at a lower speed; and fixing the item in the aligned position.

9 Claims, 3 Drawing Sheets

(51) Int. Cl.

| | |
|---|---|
| ***B65H 9/06*** | (2006.01) |
| ***B65H 9/10*** | (2006.01) |
| ***B65H 11/00*** | (2006.01) |
| ***B65H 29/12*** | (2006.01) |
| ***B65H 29/68*** | (2006.01) |
| ***B65H 43/04*** | (2006.01) |

(52) U.S. Cl.
CPC .. *B65H 2513/10* (2013.01); *B65H 2701/1311* (2013.01); *B65H 2701/1313* (2013.01); *B65H 2701/173* (2013.01); *B65H 2801/21* (2013.01)

(56) References Cited

U.S. PATENT DOCUMENTS

| | | | |
|---|---|---|---|
| 4,696,465 | A | 9/1987 | Willi |
| 5,540,152 | A | 7/1996 | DeMoore |
| 5,938,193 | A | 8/1999 | Bluemle et al. |
| 2004/0051236 | A1 | 3/2004 | Eitel et al. |
| 2010/0007082 | A1 | 1/2010 | Müller et al. |

FOREIGN PATENT DOCUMENTS

| | | | |
|---|---|---|---|
| DE | 10 2009 009 705 | A1 | 8/2010 |
| EP | 0 275 040 | A1 | 7/1988 |
| EP | 1 749 773 | A2 | 2/2007 |
| EP | 2 008 956 | A2 | 12/2008 |

APPARATUS FOR REGISTER CONTROL AND A METHOD FOR REGULATING SUCH APPARATUS

BACKGROUND OF THE INVENTION

Field of the Invention

The present invention concerns, an apparatus for conveying a sheet-formed item, the apparatus being a through-flow apparatus arranged after a digital printing unit, and a conveyor belt and before another coating or printing unit, the apparatus including an inlet side and an outlet side, wherein the apparatus between inlet side and the outlet side includes a set of conveying means, e.g., one, two or more longitudinal conveyor belts, for moving items in a conveying direction.

The invention further concerns a method for regulating an apparatus for conveying a sheet-formed item, the apparatus being a through-flow apparatus arranged after a digital printing unit and before another coating or printing unit, the apparatus including an inlet side and an outlet side, wherein the apparatus between inlet side and the outlet side includes a set of conveying means, e.g., one, two or more longitudinal conveyor belts, for moving items in a conveying direction.

Description of Related Art

It is commonly known to perform printing or application of coating/lacquer on already printed sheets, after which the sheets are passed through a drying station and subsequently stacked in a so-called "stacker". The sheets are alternatively passed directly to other functions via a suitable conveyor belt to, e.g., a punching operation. The sheets typically come from a kind of printing unit, e.g., digital printing unit, where the primary printing is performed, and the sheets are then moved through a coating unit where the relevant areas on each sheet are applied a coating. The speed at which these processes are performed are determined by the speed of the printing unit itself which thereby determines the speed of the rest of the plant.

When printing on sheets at a given speed, this also means that respective sheets run through the rest of the system with a given spacing between individual sheets corresponding to the spacing arising during feeding of the printing unit. This also means that the sheets are received and coated with a given spacing and subsequently passed through a drying station at the same speed and with the same spacing. In order to perform coating exactly at the areas desired to be coated, it is necessary to ensure that individual sheets are fixed precisely laterally (side register) and longitudinally (length register), presenting some challenges to the prior art. One solution could be to apply a coating on a larger area on the sheet in order to ensure that all print is covered by a coating. In some cases this may be possible, but requires more coating/lacquer, more drying and also meaning that a partial and accurate coating cannot be performed on a given print.

In order to achieve optimal and sufficient drying of the coated sheets before stacking, the process step with the drying station is particularly required to perform the necessary evaporation from the coating in the space actually available between the coating unit and the stacker. This spacing may of course be adapted according to need, but will soon be space-consuming which is not expedient as this in principle will require larger production areas.

In order to avoid too long drying stations, another solution is typically used, namely to mount more and/or more powerful heat sources and/or UV lamps which then can take care of the drying within the available time and distance. There is, however, an increasing desire to minimize the energy consumption in a drying station in order to optimize the total costs of performing the coating as well as the drying actions. As indicated above, there is also a desire for minimizing the space used by such a drying station.

SUMMARY OF THE INVENTION

It is the object of the invention to indicate a solution where in connection with printing and/or coating of a material in sheets, also called items, a precise regulation can be performed of individual sheets/items with regard to skew positions and with regard to displacement in directions of the side register as well as the length register, and where additionally there may be performed a deceleration of the individual sheets such that the spacing between individual sheets/items can be reduced and such that a more optimal drying process can be achieved as the sheets/items lie closer and are thereby moved more slowly through a drying station. It is the object to achieve a better drying and also a less energy-consuming drying process compared with operation at unchanged speed and thereby with greater spacing between individual sheets/items.

As mentioned in the introduction and indicated in the preamble of claim 1, the invention concerns an apparatus for conveying a sheet-formed item, the apparatus being a through-flow apparatus arranged after a digital printing unit, and a conveyor belt and before another coating or printing unit, the apparatus including an inlet side and an outlet side, wherein the apparatus between inlet side and the outlet side includes a set of conveying means, e.g., one, two or more longitudinal conveyor belts, for moving items in a conveying direction.

An apparatus according to the invention is particularly suited for application after a digital printing unit, e.g., a unit known by the trade name HP Indigo 30000 Digital Press. The invention is therefore not intended to be used together with an office model of a printer known by most people, but to be used together with professional digital printing units, which more and more supersede offset and flexographic printing in cases where it may be profitable.

The printing industry goes through a constant and rather intense evolution, and certainly there will be developed apparatuses and concepts that only make the prior art printing methods more efficient, though entirely new methods and concepts will appear as well.

In order to achieve a desired surface finish on items printed in a printing unit, digital or not, on the printed items, e.g., packing made of strong paper or cardboard punched, folded and joined after finished printing, there may be performed a kind coating—applied a surface coating—on the item.

A number of items can typically be printed on a sheet with a length of 530 mm and width of 750 mm (29×20 inch format), where, e.g., fewer or more than 6 to 8 items are printed with a suitable spacing. In order to achieve the desired surface finish, there may advantageously be applied a coat by a so-called flexographic printing unit, also called flexographic printing, on the print itself. A plate is thus brought in contact with the printed sheet and applies the coat very accurately upon the printed item. The entire item is possibly to be covered by a coating/lacquer, but it is also possible that only parts thereof are coated or are left untreated. In order to achieve the desired quality and precision of the surface treatment, and not the least in order to optimise the costs, it is advantageous that the coating is applied exactly and only where intended, requiring that respective sheets or items are controlled very precisely.

The new feature of an apparatus according to the invention is that the conveying means include means for aligning an article from one position to another position in relation to one or more reference points, wherein the said means at least include one stop, the stop or stops arranged at right angles to the conveying direction, the conveying means including drive means for driving the conveying means at at least one conveying speed, e.g., a variable conveying speed, and further adapted for receiving an item conveyed at a receiving speed on a conveyor belt disposed in front thereof, and further including fixing means for fixing an item at a given position in relation to the stop or stops.

A stop or stops can form the mentioned reference point in that an item which has been printed, but lying slightly skew on a conveyor belt moving it from the printing unit to the apparatus according to the invention can be aligned by pressing it against these stops. The conveying means can typically include two parallel juxtaposed conveyor belts upon which the stops are arranged, and which can be controlled to run with a suitable conveying speed, which advantageously can be variable as described in the following. The item moved on the conveying means will typically be received with a so-called receiving speed which is higher than or at the same level as the conveying speed. When the item is received on the conveying means, a set of fixing means are activated in the first place which at least partially retain the item at the actual position relative to the stops. The item is pressed against the stop or stops and is therefore aligned under the action of the more rapidly running conveyor belt from which the item is received. Hereby is achieved that the item no longer lies skew on the conveying means, and the surface treatment can therefore be effected with the desired precision. The speed of the item can subsequently be adapted according to need. A lower speed during application of, e.g., lacquer may have the effect in some cases that the lacquer merges more easily, whereby a higher gloss can be attained. The subsequent drying of the items may furthermore also be performed with advantage at a lower through-flow speed. The length of a drying station may hereby be minimized, and also the energy used for the drying action.

When an item leaves a printing unit, it occurs at a relatively high speed which in principle is controlled by the printing unit itself and its properties and operating conditions. For example, it may be that items/sheets are conveyed at a speed of 96 m/min corresponding to 5670 m/hr. At the same time, e.g., 4600 sheets can be printed per hour, and if the sheets have a length of 0.53 m as indicated above, this corresponds to an average spacing between respective sheets/items of:

$$(5670-(4600*0.53))/4600=\text{about } 0.70 \text{ m}.$$

The above mentioned values are only examples serving the purpose of elucidating the challenges existing during operation of such an apparatus, but the values correspond substantially to the properties that characterize an HP Indigo 3000 Digital Press machine when printing on the said sheet format.

In order that the printing process may occur with sufficient certainty and speed, this spacing between the individual sheets is necessary, but in order to perform the necessary surface treatment and drying process, a spacing of this magnitude is not so necessary. The spacing may well be less, which is the fact realized by the invention.

In an embodiment of an apparatus for conveying a sheet-formed item according to the invention, the apparatus includes means for regulating the speed of the conveying means as a function of the position of the stops on the apparatus and as a function of the position of an item. The conveying means will typically have a speed which is about the same as the speed at which the item is received. The speed of the conveying means will then be lowered and the item will thus be pushed against the stops as the faster running conveyor is still in contact with the item. When a firm contact between the leading edge of the item and stops has been established after a given period of time, the speed can either be maintained or reduced to an even lower level, though it is can also be increased again in order to keep as large spacing between the items as possible as long as possible. This and several other conditions will be explained in more detail below.

An apparatus for conveying a sheet-formed item according to the invention may advantageously be designed such that the apparatus includes fixing means where the fixing means are incorporated in the conveying means and include at least one vacuum source and a number of vacuum suction apertures. By using vacuum is achieved a secure and simple fixing, which otherwise has been used previously for other applications in connection with printing and for other types of conveyor belts.

In an embodiment of an apparatus for conveying a sheet-formed item according to the invention, the fixing means can include conveying means with vacuum suction apertures where in an area in front of the stops there are arranged a first set of apertures having a first total suction capability, and where at one or more other areas on the conveying means there is arranged one or more sets of apertures with the same or with different suction capability, typically greater suction capability, where the apertures are connected to a vacuum source. It is hereby possible to fix a sheet at least partially while at the same time pushing it against the stops, and only then fixing it completely by one or more other sets of fixing means.

In a particular embodiment of an apparatus for conveying a sheet-formed item according to the invention, the apparatus may include or be operatively connected to a printing unit, e.g., a flexographic printing unit for applying ink and/or coating on printed sheet-formed items. An item may advantageously be printed with a digital printing unit, but the desired surface treatment or surface finish can advantageously be achieved by flexographic printing.

In yet a preferred embodiment of an apparatus for conveying a sheet-formed item according to the invention, the apparatus may include or be operatively communicating with a drying station, the drying station including one or more drying means, including drying means that distribute hot air, emit heat radiation, and/or UV lamps for curing UV-setting ink and/or coating, or other suitable drying means. By positioning the individual sheets with a modest spacing corresponding to the sheets being decelerated and conveyed at a lower speed than in the previous printing process, a more efficient drying station is achieved. Such a drying station will be shorter than the previously known in that the speed of the items is lower and in that the items use more time in going through the drying station thereby, and the drying station will be more economical as the drying is effected significantly more on items rather than on an empty conveyor belt.

As mentioned above in the example, there may be a spacing of about 0.70 m between the items when they pass through, and also when they leave a digital printing unit, while at a lower speed obviously they will have a lesser spacing if printing the same number of items/sheets.

For example, the speed through a flexographic printing unit by which a coating is applied the items can be reduced to a speed of 57 m/min, corresponding to 3420 m/hr. At the same time, 4600 sheets may, e.g., be printed per hour, and if the sheets have a length of 0.53 m as indicated above, this corresponds to an average spacing in the drying station and in the flexographic printing unit between respective sheets/items of $$(3420-(4600*0.53))/4600=\text{about } 0.21 \text{ m}.$$

Also here, it is an example which, however, reflects and gives understanding of a real situation.

This lesser spacing is sufficient for respective sheets to be moved securely and without problems through the entire apparatus, and at the same time entail a marked optimisation of both surface treatment and the subsequent drying.

As mentioned, the invention also concerns a method for regulating an apparatus for conveying a sheet-formed item, the apparatus being a through-flow apparatus arranged after a digital printing unit and before another coating or printing unit, the apparatus including an inlet side and an outlet side, wherein the apparatus between inlet side and the outlet side includes a set of conveying means, e.g., one, two or more longitudinal conveyor belts, for moving items in a conveying direction.

The new feature of a method according to the invention is that the method at least includes the following method steps:

detecting an item before or at the inlet side, the item being conveyed at a first speed on a conveyor belt;

activating the conveying means for receiving and conveying an item at a second speed corresponding to or lower than the first speed;

regulating a possible skew position of the item on the conveying means as the item is moved to abut on one or two stops on the conveying means, the item being acted on by a speed from the conveyor belt, namely a first speed, and thereby pressed against the stop or stops that are moved at the second and lower speed, relative to the first speed;

fixing the item in the obtained and aligned position.

Detecting an item can be effected by a sensor suited for the purpose which in addition to this function can have other functions as well. It may be so that a previous sensor has detected an item and that the plant is stopped if this sensor has not also detected an item within a given time limit. If the time is exceeded, this means in principle that an error has occurred—typically that a sheet is stuck and has to be removed manually.

It is preferred that the apparatus with the conveying means are ready in a start position, and when the item approaches, it is started with a corresponding speed which, however, is rapidly reduced to a speed slightly lower in order thereby to enable the item to be pressed against the stop and thereby to be aligned from a skew to a straight position on the conveying means. During this process a partial fixing occurs, and after completing alignment there may advantageously be effected a further and more permanent fixation that prevents the item from being displaced again.

A method according to the invention may also include at least the following additional method steps:

increasing the first speed over a given period of time/distance for maintaining as large spacing as possible between individual items;

reducing the first speed to a lower level after a given period of time/distance;

deactivating fixing means when the item encounters the subsequent coating or printing unit, i.e. when the item comes into contact with a plate as well as counterpressure in the coating or printing unit.

By regulating the speed of a fixed item up as well as down there may be achieved an optimal spacing between succeeding items, which is some cases can be a given advantageous spacing whereas in other cases it may be a different advantageous spacing. Since, as mentioned, there is typically a rather large distance between the items when they leave the printing unit, by an apparatus and a method according to the invention the conveying speed and thereby the spacing of the items may readily be optimised in order to achieve the desired advantage in the subsequent process step or steps.

A method according to the invention may advantageously include at least one of the following additional method steps:

regulating side register based on input from one or more side sensors;

regulating length register based on input from one or more length sensors.

After aligning the item as described above, a detection of the lateral position of the item, also called the side register, can also be performed with great advantage. This is typically performed after final fixation, and may be effected by a simple mechanical movement of the said conveying means. Such a movement can be performed by a linear actuator or by other types of actuating devices. Regulation of the side register takes place based on one or more sensors that may be arranged such that one or both sides of the item are monitored. One or more such sensors will typically be connected with a kind of controller transmitting a signal to the existing actuator or actuators to perform the required adjustment. The method for this action is not so important with regard to the invention as the detection and regulation itself can be performed by prior art methods. The new feature is that alignment with regard to skewness and then alignment in the side register are performed, all of which can be effected simultaneously with a possible regulation of the conveying speed.

Also, the position of the item in longitudinal direction, called the length register, can be regulated while the item is travelling towards the subsequent coating or printing process, which is effected by adapting—maintaining, increasing or reducing—the speed at which the item is conveyed in relation to the coating or printing unit. This regulation in the length register as well as in the side register can take place on the basis of the leading edge, trailing edge, side or sides, corners or similar of the item/sheet, but it may also take place on the basis of markings on the sheet itself. Such markings can e.g., be printed in connection with performing the regular printing, and they may therefore be scanned prior to application of coat or a subsequent printing operation.

Yet an embodiment of a method according to the invention may include at least one of the following additional method steps:

conveying means with stops and mechanism for regulating side register and other means arranged in connection with the conveying means are returned to an initial position at a third speed, and are possibly stopped at a receiving position.

When an item is aligned with regard to skewness in the side as well as the length registers, and delivered to the subsequent process, e.g., a flexographic coating unit, the conveying means may advantageously be returned to a receiving/initial position and stopped until the next item is detected and is to be received and aligned in required directions. However, it may be envisaged that the pause such conveying means can have is short, and that it would be better to adapt the speed of the conveying means in relation to the next item. This is an option and can be particularly relevant in some cases, e.g., in cases with large and heavy items as well as large and heavy equipment.

By an apparatus and a method according to the invention it can be possible to receive and process items with arbitrary spacing, regular or not, and at the same time achieve an optimised coating or printing result on the items. By arbitrary spacing is meant that the items can be received with irregular spacing, two items with one spacing and then a different spacing to a subsequent item. Items may in principle be received and treated completely individually and independently of their mutual spacing.

The invention is described in the following with reference to the accompanying drawings.

DETAILED DESCRIPTION OF THE INVENTION

In the explanation of the figures, identical or corresponding elements will be provided with the same designations in different figures. Therefore, an explanation of all details will not necessarily be given in connection with each single figure/embodiment as well as all elements are not necessarily provided with designations in all Figures.

Figure 1:
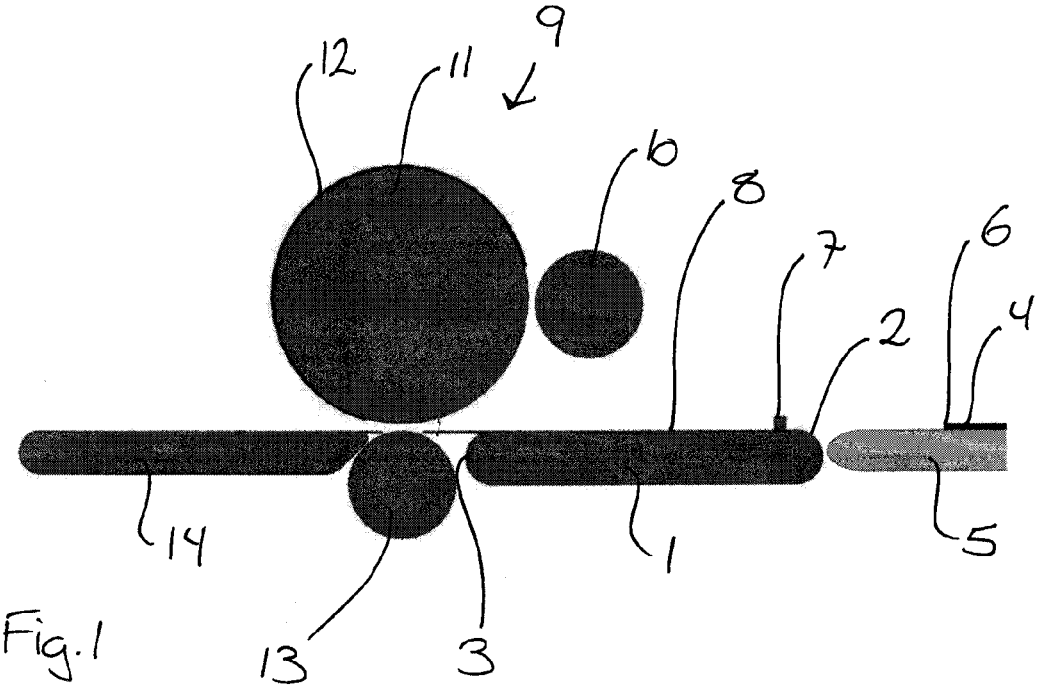
FIG. 1 shows a cross-section of the invention in a first position.

FIG. 1 shows a cross-section of the invention in a first position in which a conveying apparatus 1 with an inlet side 2 and an outlet side 3 stands ready to receive an item 4. The item 4, here in the shape of a sheet, is seen on a conveyor belt inlet 5 lying behind and moving the sheet 4 from a not shown digital printing unit and on to the subsequent process steps. The leading edge 6 is here on its way to abut on the stops 7 arranged transversely of the conveying means 8 on the conveying apparatus 1. After the conveying apparatus 1, immediately at the outlet side 3, there is arranged a flexographic printing unit 9, which here is arranged to apply a surface coating on the previously printed item 4. The flexographic printing unit 9 is shown simplified here, including an anilox roller/screen roller 10, a plate roller 11 with a plate 12, and a counter-pressure roller 13. After the flexographic printing unit 9 is seen a conveyor belt outlet 14 which can be the conveyor belt moving the items 4 on through a not shown drying station before the item lands in a not shown stacker.

In the following, the invention will be described with reference to figures that are all more or less uniform. In principle, they show the same details, though with the conveying means 8 and thereby the stops 7, and the item 4 and also the plate roller 11 in different positions. The figures are thus an expression of selected situations in the course of an item from, e.g., a digital printing unit or from at stack of printed items 4 and through a conveying apparatus 1, in which alignment of the individual items 4 occurs before a printing or coating process 9.

Figure 2:
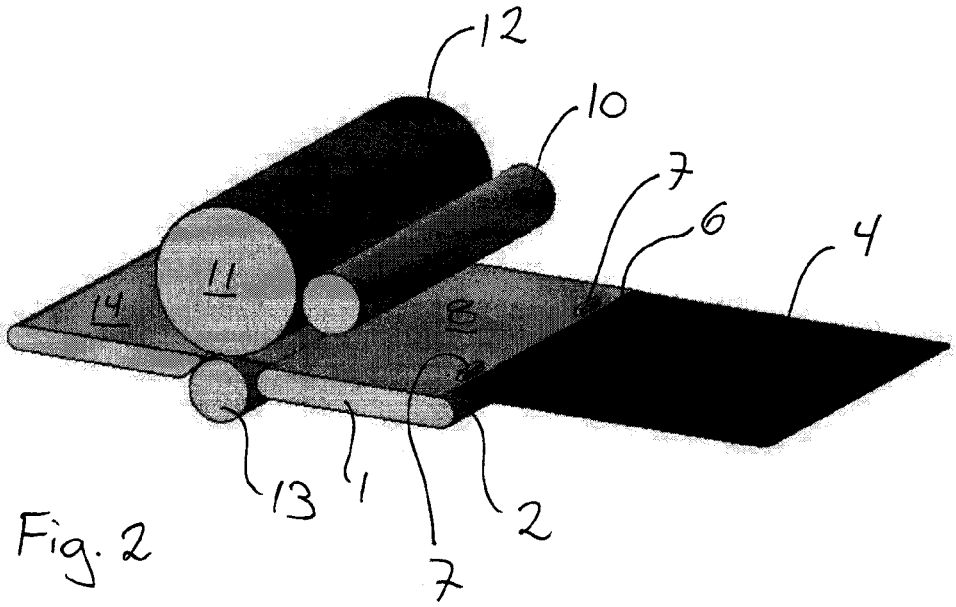
FIG. 2 shows the invention in perspective view in a second position.

FIG. 2 shows a conveying apparatus 1 according to the invention in perspective view and in a different position. The item 4 is here very close to the inlet side 1 and almost in contact with the two stops 7.

Figure 3:
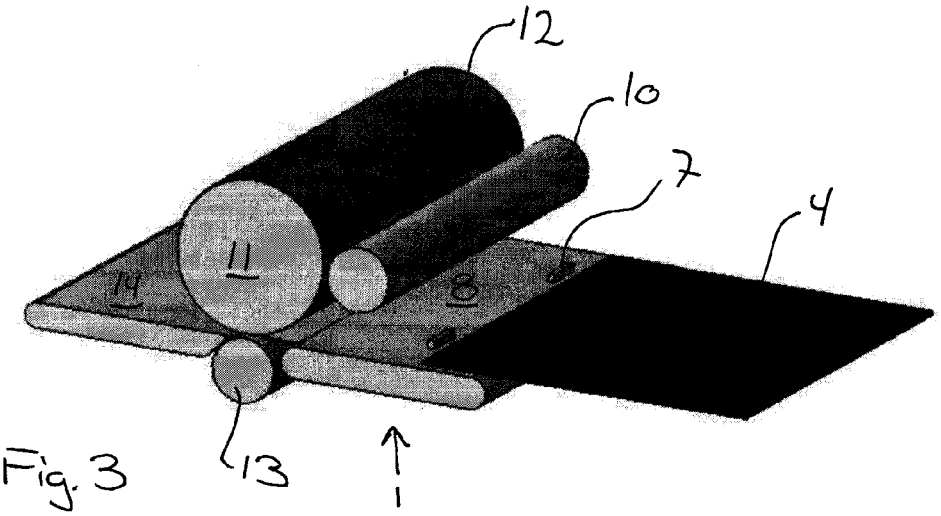
FIG. 3 shows the invention in perspective view in a third position.

FIG. 3 shows a step immediately after the one shown in FIG. 2 where the item now rests on about a third of the conveying means 8, but is still not moved against the stops 7 as the conveying means so far are operated at a speed corresponding to the speed at which the item is received from the mentioned conveyor belt inlet 5.

Figure 4:
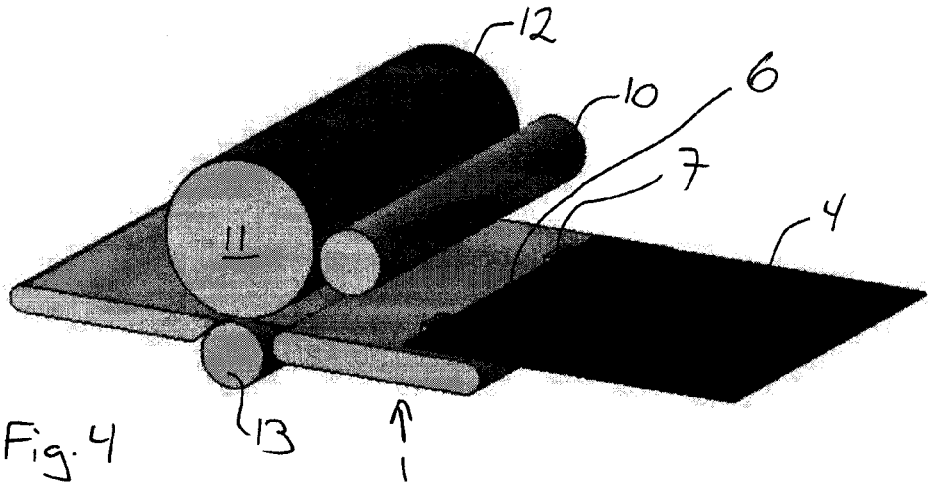
FIG. 4 shows the invention in perspective view in a fourth position.
Figure 5:
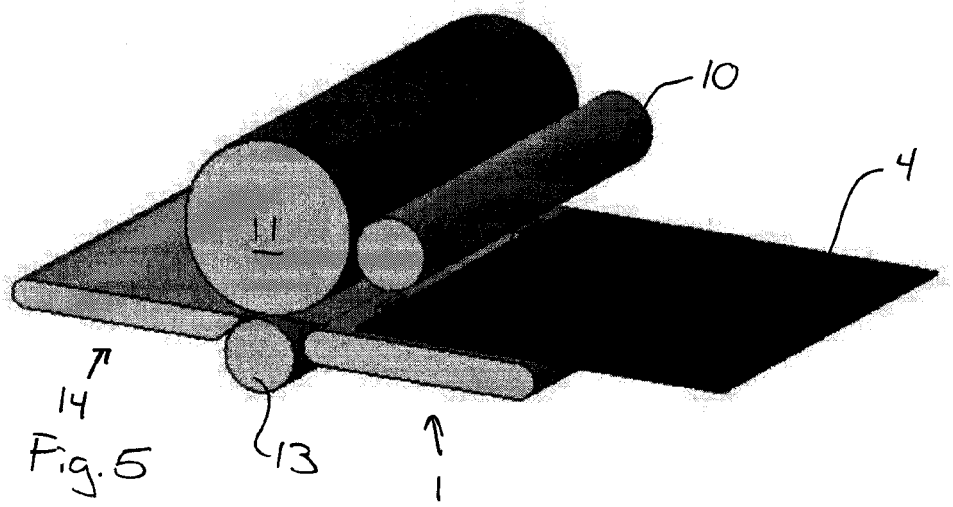
FIG. 5 shows the invention in perspective view in a fifth position.

FIG. 4 shows a view immediately after the one shown in FIG. 3 where the speed of the conveying means 8 is reduced, and where the item/sheet 4 is thus brought to bear on the stops 7 and thereby is aligned. The speed can then be increased again, maintained or reduced more. At the same time an increase in the fixing of the item 4 occurs, and at the latest at the position appearing in FIG. 5, a regulation/adjustment in the side register and/or the length register in relation to the position of the plate is performed.

Figure 6:
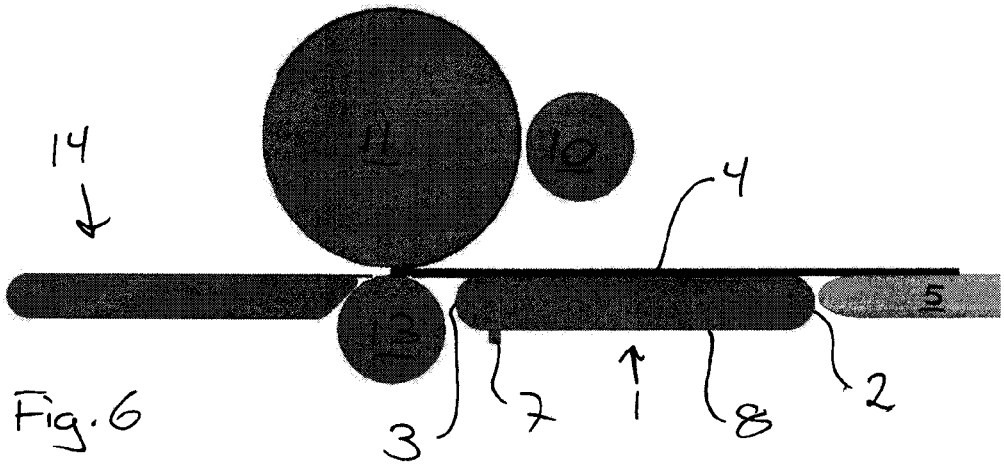
FIG. 6 shows a cross-section of the invention in a sixth position.
Figure 7:
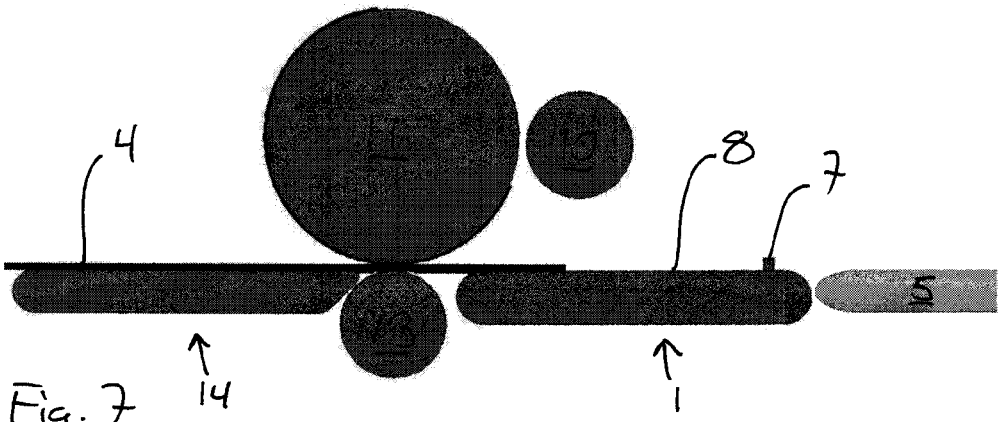
FIG. 7 shows a cross-section of the invention in a seventh position.
Figure 8:
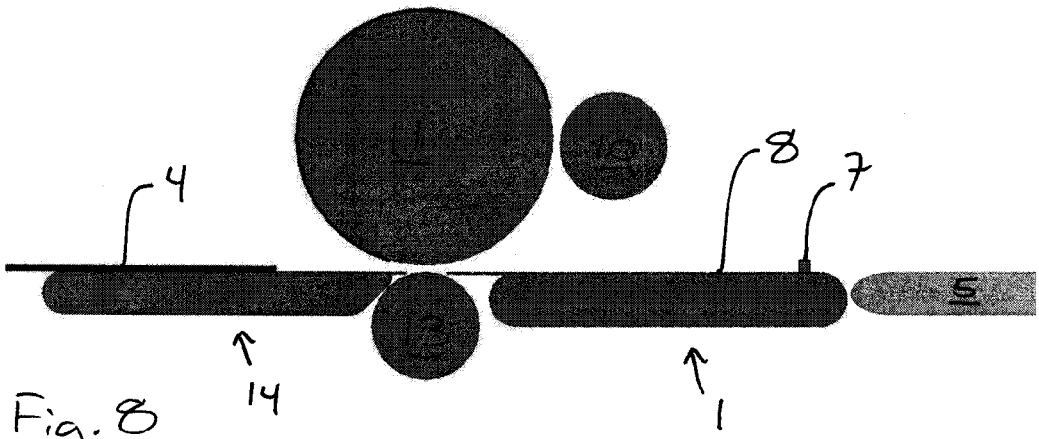
FIG. 8 shows a cross-section of the invention in an eighth position.

The following figures, namely FIGS. 6-8, show an item 4 in different positions on its way through the flexographic printing unit 9. In FIG. 6, the leading edge 6 of the item is seen in contact with the plate roller 11 and with the counter-pressure roller 13 which now take over the conveying of the item 4. Furthermore, it is also seen that the conveying means 8 are on their way to the initial position as seen in FIG. 1. It is seen here only by the position of the stops 7 which is here seen at the underside of the conveying apparatus 1. The speed of the conveying means 8 and thereby of the stops 7 can be increased after the item 4 has been in contact with the flexographic printing unit 9, and be moved to the mentioned initial position at a markedly higher speed than the speed at which the item has been conveyed, if expedient.

In FIG. 7 the item is seen on its way through the flexographic printing unit 9, and the conveying apparatus 1 is in initial position, but could very well be in the process of conveying a succeeding item 4.

Finally, in FIG. 8 is seen that the item 4 has been applied a coating and is on its way to the subsequent conveyor belt outlet 14 which can move the item either through a not shown drying station or up to a such.

What is claimed is:

1. An apparatus for conveying a sheet-formed item, wherein the apparatus is a through-flow apparatus arranged after a digital printing unit, and a conveyor belt and before another finishing or printing unit, the apparatus including an inlet side and an outlet side, wherein the apparatus between the inlet side and the outlet side includes a set of conveying means for moving items in a conveying direction, where the conveying means include means for aligning an item from one position to another position in relation to one or more reference points, wherein the said means at least include one stop, the stop or stops arranged at right angles to the conveying direction, the conveying means including drive means for driving the conveying means at at least one conveying speed and further adapted for receiving an item conveyed at a receiving speed on a conveyor belt disposed in front thereof, and further including fixing means for fixing an item at a given position in relation to the stop or stops, wherein the apparatus includes means for regulating the speed of the conveying means as a function of the position of the stops on the apparatus and as a function of the position of an item.

2. Apparatus for conveying a sheet-formed item according to claim 1, wherein the apparatus includes fixing means where the fixing means are incorporated in the conveying means and include at least one vacuum source and a number of vacuum suction apertures.

3. Apparatus for conveying a sheet-shaped item according to claim 2, wherein the fixing means include conveying means with vacuum suction apertures where in an area in front of the stops there are arranged a first set of apertures having a first total suction capability, and where at one or more other areas on the conveying means there is arranged one or more sets of apertures with the same or with different suction capability, the apertures being connected to a vacuum source.

4. Apparatus for conveying a sheet-formed item according to claim 1, wherein the apparatus includes or is operatively connected to a printing unit, for applying ink and/or coating on printed sheet-formed items.

5. Apparatus for conveying a sheet-formed item according to claim 1, wherein the apparatus includes or is operatively connected to a drying station, the drying station including one or more drying means, including drying means that at least one of distribute hot air, emit heat radiation, use UV lamps for curing UV-setting ink and/or coating.

6. A method for regulating an apparatus for conveying a sheet-formed item, the apparatus being a through-flow apparatus arranged after a digital printing unit and before another coating or printing unit, the apparatus including an inlet side and an outlet side, wherein the apparatus between inlet side and the outlet side includes a set of conveying means for moving items in a conveying direction, wherein the method includes at least the following method steps:

detecting an item before or at the inlet side, the item being conveyed at a first speed on a conveyor belt;

activating the conveying means for receiving and conveying an item at a second speed corresponding to or lower than the first speed;

regulating a possible skew position of the item on the conveying means as the item is moved to abut on one or two stops on the conveying means, the item being acted on by the first speed from the conveyor belt, and pressed against the stop or stops that are moved at the second speed that is lower relative to the first speed;

fixing the item in the obtained and aligned position.

7. Method according to claim 6, wherein the method includes at least the following additional method steps:

increasing the first speed over a given period of time/distance for maintaining as large spacing as possible between individual items;

reducing the first speed to a lower level after a given period of time/distance;

deactivating fixing means when the item encounters the subsequent coating or printing unit.

8. A method according to claim 6, wherein the method includes at least one of the following additional method steps:

regulating side register based on input from one or more side sensors;

regulating length register based on input from one or more length sensors.

9. Method according to claim 6, wherein the method includes at least one of the following additional method steps:

conveying means with stops and mechanism for regulating side register and other means arranged in connection with the conveying means are returned to an initial position at a third speed, and are possibly stopped at a receiving position.

* * * * *